US009620066B2

(12) United States Patent
Bishop

(10) Patent No.: US 9,620,066 B2
(45) Date of Patent: Apr. 11, 2017

(54) METHOD FOR DRIVING ELECTRO-OPTIC DISPLAYS

(75) Inventor: Seth J. Bishop, Framingham, MA (US)

(73) Assignee: E Ink Corporation, Billerica, MA (US)

( * ) Notice: Subject to any disclaimer, the term of this patent is extended or adjusted under 35 U.S.C. 154(b) by 756 days.

(21) Appl. No.: 13/018,829

(22) Filed: Feb. 1, 2011

(65) Prior Publication Data

US 2011/0187689 A1 Aug. 4, 2011

Related U.S. Application Data

(60) Provisional application No. 61/300,645, filed on Feb. 2, 2010.

(51) Int. Cl.
*G09G 3/34* (2006.01)

(52) U.S. Cl.
CPC ..... *G09G 3/344* (2013.01); *G09G 2300/026* (2013.01)

(58) Field of Classification Search
USPC ..... 345/1.1–1.3, 107
See application file for complete search history.

(56) References Cited

U.S. PATENT DOCUMENTS 4,418,346 A 11/1983 Batchelder
5,760,761 A 6/1998 Sheridon
5,767,818 A * 6/1998 Nishida ..... 345/1.1
5,777,782 A 7/1998 Sheridon
5,808,783 A 9/1998 Crowley
5,851,411 A * 12/1998 An et al. ..... 216/23
5,872,552 A 2/1999 Gordon, II et al.
5,930,026 A 7/1999 Jacobson et al.
6,054,071 A 4/2000 Mikkelsen, Jr.
6,055,091 A 4/2000 Sheridon et al.
6,097,531 A 8/2000 Sheridon
6,128,124 A 10/2000 Silverman
6,130,774 A 10/2000 Albert et al.
6,137,467 A 10/2000 Sheridon et al.
6,144,361 A 11/2000 Gordon, II et al.
6,147,791 A 11/2000 Sheridon
6,172,798 B1 1/2001 Albert et al.
(Continued)

OTHER PUBLICATIONS

Kitamura, T., et al., "Electrical toner movement for electronic paper-like display", Asia Display/IDW '01, p. 1517, Paper HCS1-1 (2001).

(Continued)

*Primary Examiner* — Kenneth Bukowski
(74) *Attorney, Agent, or Firm* — Antranig Baronian

(57) ABSTRACT

A large area display comprises multiple sub-units arranged in rows and columns. Each sub-unit has associated row and column drivers, with the column driver driving the column electrodes of all the sub-units a column. A chip select means provides a separate chip select signal to each row of sub-units, so that only one row of sub-units are scanned at a time, and all the sub-units in the selected row are scanned simultaneously. Column data are supplied to the column drivers as a linear series of column data values; and delayed Gate Start Pulse signals are fed to the column drivers in each column of sub-units after the first so that these column drivers receive the delayed Gate Start Pulse signals and apply the appropriate column data values to their associated column electrodes.

14 Claims, 1 Drawing Sheet

(56) References Cited

U.S. PATENT DOCUMENTS 6,184,856 B1 2/2001 Gordon, II et al.
6,225,971 B1 5/2001 Gordon, II et al.
6,241,921 B1 6/2001 Jacobson et al.
6,252,564 B1 6/2001 Albert et al.
6,271,823 B1 8/2001 Gordon, II et al.
6,292,157 B1 * 9/2001 Greene et al. ..... 345/1.3
6,301,038 B1 10/2001 Fitzmaurice et al.
6,445,489 B1 9/2002 Jacobson et al.
6,504,524 B1 1/2003 Gates et al.
6,512,354 B2 1/2003 Jacobson et al.
6,531,997 B1 3/2003 Gates et al.
6,672,921 B1 1/2004 Liang et al.
6,753,999 B2 6/2004 Zehner et al.
6,788,449 B2 9/2004 Liang et al.
6,825,970 B2 11/2004 Goenaga et al.
6,866,760 B2 3/2005 Paolini, Jr. et al.
6,870,657 B1 3/2005 Fitzmaurice et al.
6,900,851 B2 5/2005 Morrison et al.
6,922,276 B2 7/2005 Zhang et al.
6,950,220 B2 9/2005 Abramson et al.
6,982,178 B2 1/2006 LeCain et al.
6,995,550 B2 2/2006 Jacobson et al.
7,002,728 B2 2/2006 Pullen et al.
7,012,600 B2 3/2006 Zehner et al.
7,023,420 B2 4/2006 Comiskey et al.
7,034,783 B2 4/2006 Gates et al.
7,075,502 B1 7/2006 Drzaic et al.
7,116,318 B2 10/2006 Amundson et al.
7,116,466 B2 10/2006 Whitesides et al.
7,119,772 B2 10/2006 Amundson et al.
7,170,670 B2 1/2007 Webber
7,193,625 B2 3/2007 Danner et al.
7,202,847 B2 4/2007 Gates
7,236,291 B2 6/2007 Kaga et al.
7,259,744 B2 8/2007 Arango et al.
7,304,787 B2 12/2007 Whitesides et al.
7,312,784 B2 12/2007 Baucom et al.
7,312,794 B2 12/2007 Zehner et al.
7,321,459 B2 1/2008 Masuda et al.
7,327,511 B2 2/2008 Whitesides et al.
7,339,715 B2 3/2008 Webber et al.
7,369,299 B2 5/2008 Sakurai et al.
7,411,719 B2 8/2008 Paolini, Jr. et al.
7,420,549 B2 9/2008 Jacobson et al.
7,453,445 B2 11/2008 Amundson
7,492,339 B2 2/2009 Amundson
7,528,822 B2 5/2009 Amundson et al.
7,535,624 B2 5/2009 Amundson et al.
7,545,358 B2 6/2009 Gates et al.
7,561,116 B2 * 7/2009 Westerinen et al. ..... 345/1.1
7,583,251 B2 9/2009 Arango et al.
7,602,374 B2 10/2009 Zehner et al.
7,612,760 B2 11/2009 Kawai
7,679,599 B2 3/2010 Kawai
7,679,814 B2 3/2010 Paolini et al.
7,688,297 B2 3/2010 Zehner et al.
7,705,823 B2 4/2010 Nihei et al.
7,729,039 B2 6/2010 LeCain et al.
7,733,311 B2 6/2010 Amundson et al.
7,733,335 B2 6/2010 Zehner et al.
7,787,169 B2 8/2010 Abramson et al.
7,839,564 B2 11/2010 Whitesides et al.
7,952,557 B2 5/2011 Amundson et al.
7,956,841 B2 6/2011 Albert et al.
7,999,787 B2 8/2011 Amundson et al.
8,009,348 B2 8/2011 Zehner et al.
8,077,141 B2 12/2011 Duthaler et al.
8,125,501 B2 2/2012 Amundson et al.
8,139,050 B2 3/2012 Jacobson et al.
8,174,490 B2 5/2012 Whitesides et al.
8,289,250 B2 10/2012 Zehner et al.
8,300,006 B2 10/2012 Zhou et al.
8,305,341 B2 11/2012 Arango et al.
8,314,784 B2 11/2012 Ohkami et al.
8,384,658 B2 2/2013 Albert et al.
8,558,783 B2 10/2013 Wilcox et al.
8,558,785 B2 10/2013 Zehner et al.
2002/0075204 A1 * 6/2002 Nakano et al. ..... 345/55
2002/0109658 A1 * 8/2002 Noguchi ..... 345/92
2003/0102858 A1 6/2003 Jacobson et al.
2005/0122284 A1 6/2005 Gates et al.
2005/0253777 A1 11/2005 Zehner et al.
2005/0259068 A1 11/2005 Nihei et al.
2006/0087479 A1 4/2006 Sakurai et al.
2006/0087489 A1 4/2006 Sakurai et al.
2006/0087718 A1 4/2006 Takagi et al.
2006/0209008 A1 9/2006 Nihei et al.
2006/0214906 A1 9/2006 Kobayashi et al.
2006/0231401 A1 10/2006 Sakurai et al.
2007/0046591 A1 3/2007 Shishido et al.
2007/0091418 A1 4/2007 Danner et al.
2007/0103427 A1 5/2007 Zhou et al.
2008/0024429 A1 1/2008 Zehner
2008/0024482 A1 1/2008 Gates et al.
2008/0136774 A1 6/2008 Harris et al.
2008/0252630 A1 * 10/2008 Kim et al. ..... 345/208
2008/0291129 A1 11/2008 Harris et al.
2009/0174651 A1 7/2009 Jacobson et al.
2009/0179923 A1 7/2009 Amundson et al.
2009/0189848 A1 7/2009 Maeda
2009/0195568 A1 8/2009 Sjodin
2009/0237350 A1 9/2009 Yamada
2009/0322721 A1 12/2009 Zehner et al.
2010/0220121 A1 9/2010 Zehner et al.
2010/0265561 A1 10/2010 Gates et al.

OTHER PUBLICATIONS

Yamaguchi, Y., et al., "Toner display using insulative particles charged triboelectrically", Asia Display/IDW '01, p. 1729, Paper AMD4-4 (2001).
Hayes, R.A., et al., "Video-Speed Electronic Paper Based on Eiectrowetting", Nature, vol. 425, Sep. 25, pp. 383-385 (2003).
International Search Report and Written Opinion for PCT/US2011/023340, published on or about Sep. 26, 2011, pp. 1-12 (2011).

* cited by examiner

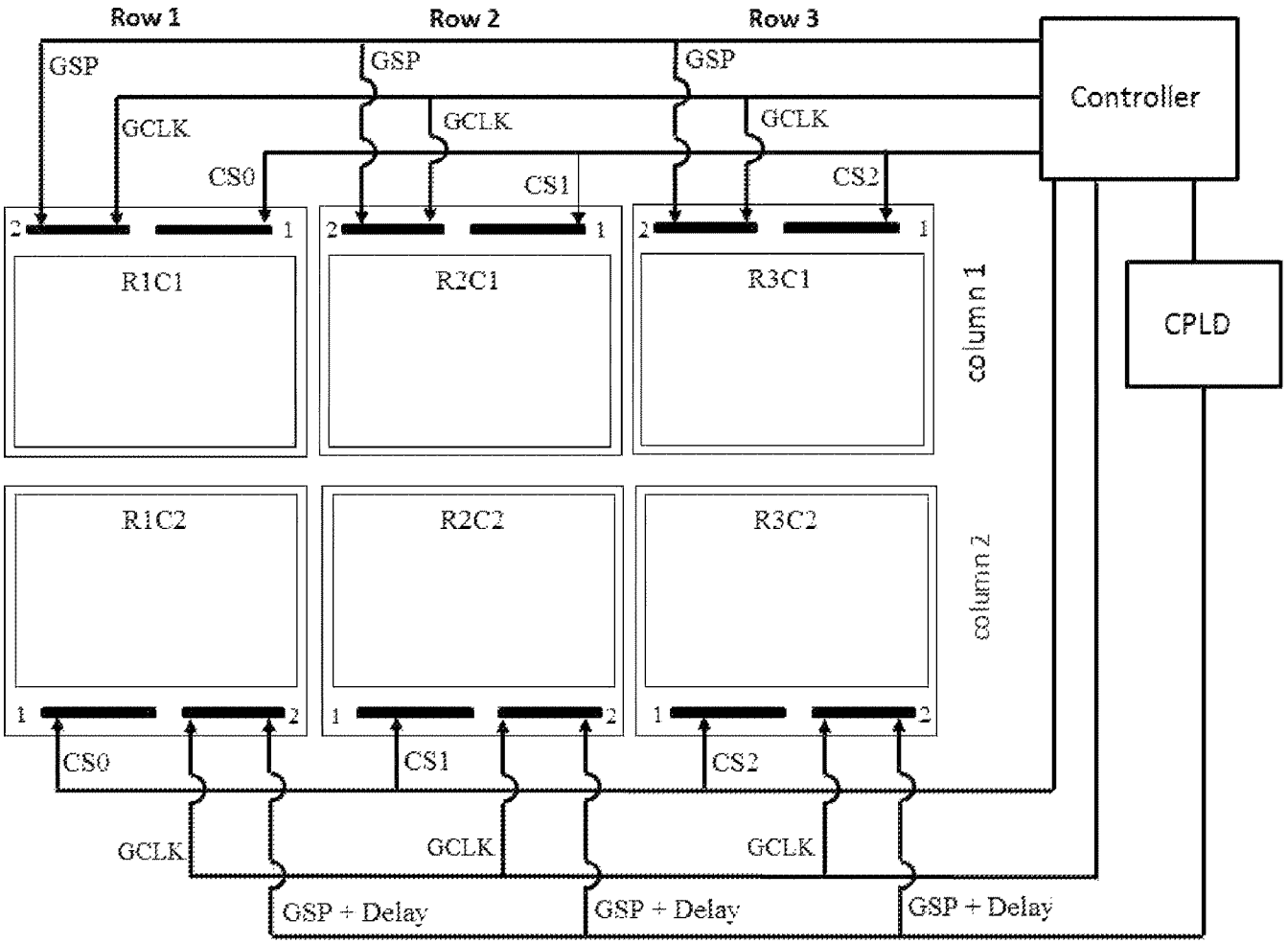
Controller
CPLD
Row 1
Row 2
Row 3
column 1
column 2
GSP
GCLK
CS0
CS1
CS2
R1C1
R2C1
R3C1
R1C2
R2C2
R3C2
GSP + Delay

METHOD FOR DRIVING ELECTRO-OPTIC DISPLAYS

REFERENCE TO RELATED APPLICATIONS

This application claims benefit of provisional Application Ser. No. 61/300,645, filed Feb. 2, 2010.

This application is related to U.S. Pat. No. 6,252,564 and U.S. Patent Publication No. 2005/0253777. The entire contents of these documents, and of all other U.S. patents and published and copending applications mentioned below, are herein incorporated by reference.

BACKGROUND OF INVENTION

This invention relates to a method for driving electro-optic displays. More specifically, this invention relates to a method for driving large displays, especially displays which are "tiled" in the sense that the large display consists of an assembly of smaller displays (of sub-units) interconnected to function as a single large display. The term "tiled display" does not imply that all the sub-units of the large display are identical, although obviously it is often convenient to use such identical sub-units.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Patent Publication Nos. 2005/0259068, 2006/0087479, 2006/0087489, 2006/0087718, 2006/0209008, 2006/0214906, 2006/0231401, 2006/0238488, 2006/0263927 and U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase.

Typically, the capsules are themselves held within a polymeric binder to form a coherent layer positioned between two electrodes. The technologies described in the these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Films and sub-assemblies containing electro-optic materials; see for example U.S. Pat. Nos. 6,982,178 and 7,839,564;

(d) Backplanes, adhesive layers and other auxiliary layers and methods used in displays; see for example U.S. Pat. Nos. 7,116,318; and 7,535,624;

(e) Color formation and color adjustment; see for example U.S. Pat. No. 7,075,502; and U.S. Patent Application Publication No. 2007/0109219;

(f) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,733,311; 7,733,335; 7,729,039; and 7,787,169; and U.S. Patent Applications Publication Nos. 2003/0102858; 2005/0122284; 2005/0179642; 2005/0253777; 2005/0280626; 2006/0038772; 2006/0139308; 2007/0013683; 2007/0091418; 2007/0103427; 2007/0200874; 2008/0024429; 2008/0024482; 2008/0048969; 2008/0129667; 2008/0136774; 2008/0150888; 2008/0165122; 2008/0211764; 2008/0291129; 2009/0174651; 2009/0179923; 2009/0195568; 2009/0256799; 2009/0322721; 2010/0045592; 2010/0220121; 2010/0220122; and 2010/0265561;

(g) Applications of displays; see for example U.S. Pat. No. 7,312,784; and U.S. Patent Application Publication No. 2006/0279527; and (h) Non-electrophoretic displays, as described in U.S. Pat. Nos. 6,241,921; 6,950,220; and 7,420,549.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode may be useful in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

Other types of electro-optic media may also be used in the displays of the present invention.

Encapsulated electrophoretic and certain other types of electro-optic displays can be made light in weight, easy to read under a variety of lighting conditions, and have low power consumption per unit area, especially having regard to their bistability, since a bistable display only draws power when the image thereon is being rewritten (or refreshed, if an single image has to be displayed for so long a period that the quality of the displayed image begins to decline). These advantages render such displays very suitable for large area displays, for example billboard type displays or large data displays for use in sports stadia or airports or railroad stations. It is convenient to form such large area displays by tiling together a number of sub-units; see, for example, the aforementioned U.S. Pat. No. 6,252,564. Two key advantages accrue from such a modular design. First, many different display configurations can be formed by assembling tiles or modules in different arrangements. Second, if a single module fails, it can be replaced in the field, at a much lower cost than replacing the entire display.

Such large area displays typically have a complex hierarchy of physical elements, signals and controllers. The sub-units or individual tiles may contain a certain number of pixels, or one or more characters in the case of a segmented, starburst or mosaic display. These tiles are then connected together, physically and electronically, to create a single display. The display will typically be addressed by a single controller, which may or may not distribute signals to "line controllers", which address individual lines or portions of the display. In turn, the signals may then be applied directly to the display elements, or may be used as control signals for display drivers, or may be further interpreted and processed by separate controllers for each module or tile.

Obviously, in order to keep costs as low as possible, it is desirable to construct such large area displays using off-the-shelf rather than purpose-built components, especially since the number of such large area displays sold is likely to be much lower than that of other types of electro-optic displays (for example, portable electronic book readers). In particular, it is desirable that the single controller of the large area display comprise one or more controllers designed to drive a single panel of the type used in the large area display.

It might at first glance appear that, since the large area display is bistable and since rapid updates are not likely to be a major concern in large area displays used as, for example departure boards in railroad stations and airports, the logical way to update a large area display comprised of a number of identical sub-units would be a use a controller designed to drive a single sub-unit, and simply arrange to switch the output of the controller to each sub-unit in succession. Although such a driving method is sound in principle, it is often impossible in practice because of the physical limitations of conventional display controllers and the interfaces used to connect such display controllers to sub-units in large area displays. In many cases, there are simply not enough select lines available either on the display controller or on the interfaces connecting the display controller to the sub-units of the large area display, and, as previously noted, the numbers of large area displays sold are not sufficient to justify modifications of the controllers and interfaces in such large area displays.

The present invention relates to a method of driving a large area display which reduces or eliminates the aforementioned problems due to the limited number of select lines on display controllers and/or interfaces.

SUMMARY OF INVENTION

Accordingly, this invention provides a method of driving a large area display comprising a plurality of sub-units arranged in a plurality of rows and columns, each sub-unit having an associated row driver and an associated column driver, the sub-units within each column being interconnected such that the associated column driver drives the column electrodes of all the sub-units within the column. The method comprises providing a separate chip select signal to each row of sub-units, so that only one row of sub-units is scanned at any one time, and all of the sub-units in the selected row are scanned simultaneously. The method further comprises supplying column data to the column drivers as a linear series of column data values under the control of a Gate Start Pulse signal and a Gate Clock signal, the Gate Start Pulse signal indicating the start of a new row of data and the Gate Clock signal indicating that a new column data value is to be supplied, and wherein delayed Gate Start Pulse signals are fed to the column drivers in each column of sub-units after the first so that the column drivers in each column of sub-units after the first receive the delayed Gate Start Pulse signals and apply the appropriate column data values to their associated column electrodes.

In one form of this method, the Gate Start Pulse and Gate Clock signals are provided to a programmable logic device which generates a delayed Gate Start Pulse signal at a time appropriate for the column drivers associated with a column of sub-units after the first to begin receiving data. For this purpose, the column data may be supplied to the column drivers as a linear series of column data extending across all the columns in all the sub-units of a row of sub-units, and the delayed Gate Start Pulse signal may cause bytes 1 to N of the linear series of data (where N is a integer equal to the number of columns in the sub-units of the first column) to be placed in shift registers of the column drivers in the first column of sub-units, and bytes (N+1) to 2N to be placed in shift registers of the column drivers in the second column of sub-units.

In another form of the method of the present invention, a display controller generates a number k of chip select signals (where k is an integer smaller than the number of rows of sub-units in the large area display) and the chip select signals from the display controller are supplied to a row selection means which generates Xk secondary chip select signals (where X is an integer such that Xk is at least equal to the number of rows of sub-units in the large area display), and the secondary chip select signals are used to supplied to the row drivers of the large area display and control which row of sub-units are rewritten at any given time.

This invention also provides a large area display comprising:

- a plurality of sub-units arranged in a plurality of rows and columns, each sub-unit having an associated row driver and an associated column driver, the sub-units within each column being interconnected such that the associated column driver drives the column electrodes of all the sub-units within the column;
- chip select means for providing a separate chip select signal to each row of sub-units, so that only one row of sub-units is scanned at any one time, and all of the sub-units in the selected row are scanned simultaneously;
- column data supply means for supplying column data to the column drivers as a linear series of column data values; and
- means for feeding delayed Gate Start Pulse signals to the column drivers in each column of sub-units after the first so that the column drivers in each column of sub-units after the first receive the delayed Gate Start Pulse signals and apply the appropriate column data values to their associated column electrodes.

In one form of such a large area display, the means for feeding delayed Gate Start Pulse signals may comprise means for generating Gate Start Pulse and Gate Clock signals, the Gate Start Pulse signal indicating the start of a new row of data and the Gate Clock signal indicating that a new column data value is to be supplied, and a programmable logic device which receives the Gate Start Pulse and Gate Clock signals and generates the delayed Gate Start Pulse signals. The column data supply means may be arranged to supply the column data to the column drivers as a linear series of column data extending across all the columns in all the sub-units of a row of sub-units, and the means for feeding delayed Gate Start Pulse signals may be arranged to cause bytes 1 to N of the linear series of data (where N is a integer equal to the number of columns in the sub-units of the first column) to be placed in shift registers of the column drivers in the first column of sub-units, and bytes (N+1) to 2N to be placed in shift registers of the column drivers in the second column of sub-units.

The large area display of the present invention may further comprise a display controller arranged to generate a number n of chip select signals (where k is an integer smaller than the number of rows of sub-units in the large area display) and a row selection means arranged to receive the chip select signals from the display controller and to generate Xk secondary chip select signals (where X is an integer such that Xk is at least equal to the number of rows of sub-units in the large area display), and to supply the secondary chip select signals to the row drivers of the large area display. Also, in the present large area display, at least one of the sub-units may be provided, along an edge where it abuts another sub-unit, with optical means arranged to reduce the apparent width of a gap between the sub-units. Such an optical means may comprise a lens molded into the viewing surface of the sub-unit. Alternatively, at least one of the sub-units may be provided with an electro-optic medium which continues over an edge of the sub-unit where it abuts another sub-unit.

The large area display of the present invention may make use of any of the types of electro-optic media described above. Thus, for example, the display may comprise a rotating bichromal member or electrochromic electro-optic medium. Alternatively, the display may comprise an electrophoretic medium which itself comprises a plurality of electrically charged particles disposed in a fluid and capable of moving through the fluid under the influence of an electric field. The electrically charged particles and the fluid may be confined within a plurality of capsules or microcells, or may be present as a plurality of discrete droplets surrounded by a continuous phase comprising a polymeric material. The fluid may be liquid or gaseous.

BRIEF DESCRIPTION OF THE DRAWING

The sole FIGURE of the accompanying drawing is a schematic top plan view of a large area display of the present invention.

DETAILED DESCRIPTION OF THE INVENTION

As already noted, the accompanying drawing is a schematic top plane view of a large area display of the present invention. This large area display is formed from six sub-units arranged in three rows and two columns, the individual sub-units being denoted R[ow]1C[olumn]1 etc. (The terms "rows" and "columns" are used herein not in the layman's sense of referring to horizontal and vertical lines but in the conventional manner by those skilled in the technology of active matrix electro-optic displays, i.e., "row" refers to a line of pixels or sub-units which are selected simultaneously and "column" refers to a group of pixels or sub-units interconnected by a column electrode. Thus, in the FIGURE, the rows of both pixels and sub-units are vertical as illustrated, while the columns are horizontal.) For purposes of illustration, it will be assumed that the individual sub-units have a resolution of 800 rows by 600 columns, so that the entire large area display shown in the FIGURE is an electro-optic display having a resolution of 2400 rows by 1200 columns. Although the FIGURE, for ease of illustration, shows substantial gaps between adjacent sub-units, it will be appreciated that in practice every attempt should be made to reduce these gaps to the minimum possible size so that overall display does appear to the observer as a single continuous display with no visible breaks within the active area of the display. Methods for reducing the visual effect of breaks between the sub-units are described below.

Each sub-unit has an associated row driver 1 and column driver 2. (This is convenient and conventional but not strictly necessary. A single row or column driver of sufficient capacity could operate multiple adjacent physical displays, or multiple low capacity low or column drivers could be used in a single sub-unit. In such cases, it may be necessary to distinguish "drivable" sub-units from physical sub-units; this invention is basically concerned with the former.) Each row driver 1 receives a chip select signal (designated CS) from the display controller (not shown). However, each row of sub-units receives a different chip select signal, three signals designated CS0, CS1 and CS2 being supplied to the sub-units in rows 1, 2 and 3 respectively. The three signals CS0, CS1 and CS2 are timed such that the 800 rows in row 1 are scanned, followed by the 800 rows in row 2 and finally the 800 rows in row 3. (Note that although both sub-units in row 1, i.e., R1C1 and R1C2 are scanned simultaneously, it is not essential that the same row in each sub-unit be scanned at the same time; for example, the rows in R1C1 could be scanned from left to right as illustrated in the FIGURE, while the rows in R1C2 could be scanned from right to left at the same time. However, in general it is preferred that the same row in each sub-unit be scanned at the same time since, if the scanning is slow enough to be perceived by the eye, this will produce a "horizontal wipe" effect typically well tolerated by observers.) In effect, the three chip select signals CS0, CS1 and CS2 enable the 2400 lines of the large area display to be scanned exactly as if it were a single conventional display.

The handling of the input signals to the column drivers 2 is somewhat more complicated. As already mentioned, in a conventional electro-optic display, the column data (defining what voltages to be asserted on the various column electrodes) are supplied to the column drivers as a linear series of digital column data values under the control of a Gate Start Pulse (GSP) signal and a Gate Clock (GCLK) signal, the GSP signal indicating the start of a new row of data and the GCLK signal indicating that a new column data value is supplied. Upon an appropriate transition in the GSP signal, the column drivers place data into a shift register at a rate of one byte per Gate Clock (GCLK) pulse. From the shift register, the data is latched and fed to digital/analogue converters which supply the appropriate voltages to each column electrode in a manner which is entirely conventional and need not be described in detail herein. In principle, one could load the column drivers for both columns of sub-units of the large area display shown in the FIGURE by taking the output from the shift registers of the column drivers of the first column of sub-units and sending them to the shift registers of the second column of sub-units. However, in practice, most commercial column drivers and/or connector interfaces do not provide an appropriate output from the column driver shift register. Accordingly, it is necessary for the large area display shown in the FIGURE to be provided with different circuitry for ensuring that the column drivers for the second column of sub-units (hereinafter the "second column drivers") to be provided with appropriate inputs to their shift registers.

For this purpose, the large area display is provided with a programmable logic device (CPLD), which receives the GSP and GCLK signals from the display controller and generates a delayed GSP ("dGSP") signal at a time appropriate from the second column drivers to begin receiving data into their shift registers, this dGSP signal (denoted "GSP+delay" in the FIGURE) being fed to the inputs of the second column drivers which would normally receive the GSP signal. As already noted, the column drivers are designed so that, upon receipt of an appropriate transition in the GSP signal, the column drivers place data into a shift register at a rate of one byte per Gate Clock (GCLK) pulse. In the case of the large area display shown in the FIGURE, upon receipt of the appropriate transition in the GSP signal, the column drivers for the first column of sub-units ("the first column drivers") proceed to place 600 successive bytes of data from the display controller into their shift registers at the rate of one bite per GCLK signal. The CPLD, upon receipt of the appropriate transition in the GSP signal, starts to count GCLK pulses, but does not generate any change in the level of the dGSP signal as yet. Note that since the second column drivers have not as yet experienced any transition in the dGSP signal, none of the first 600 bytes of data have been placed in the shift registers of these second column drivers.

After the receipt of the 600th byte of column data, the shift registers of the first column drivers are full, and subsequent bytes are ignored by the first column drivers. However, when the 600th GCLK pulse is received, the CPLD generates an appropriate transition in the dGSP signal, so that the second column drivers begin to place incoming bytes of data from the display controller into their shift registers. The second column drivers proceed to accumulate 600 bytes of data in this manner. Thus, at the end of the entire process, the shift registers of the first column drivers contain bytes 1-600 from the display controller, while the shift registers of the second column drivers contain bytes 601-1200. In effect, the entire large area display "appears" to the display controller as a single 1200 pixel wide display.

From the foregoing, it will be seen that the present invention simplifies the hardware design of a large area display and greatly simplifies the software required to operate the display since the driving electronics can treat the system of six sub-units as one display with three source drivers and two column drivers.

It will be apparent to those skilled in the art that numerous changes and modifications can be made in the specific embodiments of the invention described above without departing from the scope of the invention. For example, the large area display shown in the FIGURE could readily be adapted to accommodate additional columns of sub-units by arranging the CPLD to generate a plurality of dGSP signals at appropriate intervals, with the first dGSP signal being fed to the second column drivers, the second dGSP signal to the third column drivers, the third dGSP signal to the fourth column drivers etc., the various dGSP signals being timed so that (again assuming each display is 600 columns wide), at the end of each complete line, the shift registers of the first column drivers contain bytes 1-600 from the display controller, the shift registers of the second column drivers contain bytes 601-1200, the shift registers of the third column drivers contain bytes 1201-1800, the shift registers of the fourth column drivers contain bytes 1801-2400, etc.

The specific embodiment of the invention shown in the FIGURE is limited to a number of rows of sub-units equal to the number of chip select (CS) signals (three in the specific embodiment discussed above) available from the display controller. However, this limitation can be overcome by interposing between the display controller and the CS inputs of the various row controllers a row selection circuit which receives the RESET, CS0, CS1 and CS2 signals from the display controller (the RESET signal being a signal which indicates that the row controllers should reset to an initial state ready to begin a complete new scan), and, as the display controller repeatedly cycles through the CS0, CS1 and CS2 signals, generates appropriate CS signals for more than three rows of sub-units. For example, in a display with nine rows of sub-units, the row selection circuit might operate as follows (where the successive rows of the table below are assumed to follow each other at regular intervals, and "CSRn" indicates a signal applied to the CS input of row controllers in row n of the sub-units):

| Signal from display controller | Output from row selection circuit |
|---|---|
| CS0 | CSR1 |
| CS1 | CSR2 |
| CS2 | CSR3 |
| CS0 | CSR4 |
| CS1 | CSR5 |
| CS2 | CSR6 |
| CS0 | CSR7 |
| CS1 | CSR8 |
| CS2 | CSR9 |
| (Cycle repeats) | |

In effect, and again assuming two columns of 800×600 pixel sub-units, what "appears" to the display controller to be the writing of three successive 1600×1800 images is in reality the writing of a single 1600×5400 image.

As noted above, one of the inherent problems with a large area display composed of a plurality of sub-units is concealing from a viewer, as far as possible, the junctions between sub-units, since customer acceptance of such displays is very adversely affected if viewers can see a pattern of non-switching areas between the sub-units. In many cases, it is not possible to extend the electro-optic material to the extreme edges of the sub-units since many types of sub-unit require some type of edge seal either to hold an electro-optic material in position or to prevent the entry of moisture and other environmental contaminants which may adversely affect the performance of the sub-unit.

Methods for concealing the junctions between sub-units may be divided into optical methods and physical methods. The term "optical methods" refers to methods in which the join is physically present but the optical properties of the display are arranged to wholly or partially hide the junction area from a viewer. For example, a peripheral portion of one or both sub-units along the junction may be modified so the viewer sees an image of the peripheral portion which is wider than the peripheral portion itself, so that the image covers at least part of the junction area, thus hiding the non-switching junction area. Appropriate forms of lens for effecting such widening of the image are well known, and are used for example in lenticular displays to enable an image of a series of narrow spaced strips to form a continuous image for a viewer. To provide the necessary lens without major expense, it is generally advantageous to modify the form of the polymeric protective layer which will typically be present on the viewing surface of a display; such polymeric protective layers are often formed of thermoplastics (for example, polyethylene terephthalate), and can readily be embossed or thermally formed to provide the necessary lens. Since the effect of the lens is to create an image of certain pixels wider than the pixels themselves, some distortion of the image may be visible at the junction, and to avoid such distortion it may be desirable to make pixel in the peripheral area smaller in one dimensions than other pixels in the display, such that the reduced size pixels appear full sized in the image produced by the lens.

The term "physical methods" refers to methods in which the structure of the sub-units is arranged so as to produce a reduced junction area between adjacent pixels. In one important physical method, a flexible electro-optic medium is used, and this flexible medium is carried over the edge of the sub-unit in the junction area; in many cases, it will be necessary or desirable to provide a curved edge on the sub-unit to avoid damage to the electro-optic medium. Any necessary edge seal for the electro-optic medium can then be provided on a side surface of the sub-unit at a location spaced from the viewing surface of the large area display where the edge seal is hidden by the overlying electro-optic medium. If the electro-optic medium is carried over the edges of both sub-units in the junction area in this manner, the non-switching area can be reduced to a negligible width and hence made virtually invisible to a view of the large area display.

In view of these numerous changes and modifications, the whole of the foregoing description is to be interpreted in an illustrative and not in a limitative sense.

The invention claimed is:

1. A method of driving a large area display comprising a plurality of sub-units arranged in a plurality of rows and columns, each sub-unit having an associated row driver and an associated column driver, the sub-units within each column being interconnected such that the associated column driver drives the column electrodes of all the sub-units within the column such that the plurality of sub-units of the large area display are scanned as a single display, the method comprising:

sequentially providing a separate chip select signal to each row driver associated with a row of sub-units, sequentially scanning each row of pixels in the row of sub-units for which the associated row driver has received the chip select signal so that only the rows of pixels within a single row of sub-units is scanned at any one time, supplying column data to a first shift register of a first column drivers as a linear series of column data values under the control of a Gate Start Pulse signal and a Gate Clock signal, the Gate Start Pulse signal indicating the start of a new row of data to the first shift register and the Gate Clock signal indicating that a new column data value is to be supplied to the first shift register, and supplying the column data to a second shift register of a second column driver as a linear series of column data values under the control of a delayed Gate Start Pulse signal and the Gate Clock signal, the delayed Gate Start Pulse signal indicating the start of a new row of data to the second shift register and the Gate Clock signal indicating that a new column data value is to be supplied to the second shift register.

2. A method according to claim 1 wherein the Gate Start Pulse and Gate Clock signals are provided to a programmable logic device which generates the delayed Gate Start Pulse signal at a time appropriate for the second column driver to begin receiving data.

3. A method according to claim 2 wherein the column data are supplied to the first and second column drivers as a linear series of column data extending across all the columns in all the sub-units of a row of sub-units, and the delayed Gate Start Pulse signal causes bytes 1 to N of the linear series of data (where N is an integer equal to the number of columns in the sub-units of the first column) to be placed in the first shift registers of the first column driver, and bytes (N+1) to 2N to be placed in the second shift register of the second column driver.

4. A large area display comprising:

a plurality of sub-units arranged in a plurality of rows and columns, each sub-unit having an associated row driver and an associated column driver, the sub-units within each column being interconnected such that the associated column driver drives the column electrodes of all the sub-units within the column;

chip select means for providing a separate chip select signal to each row of sub-units, so that in the row of sub-units for which the associated row driver has received the chip select signal, only the rows of pixels within a single row of sub-units is scanned at any one time;

column data supply means for supplying column data to the column drivers as a linear series of column data values;

means for feeding, for each row scanned, delayed Gate Start Pulse signals to the column drivers in each column of sub-units after the first so that the column drivers in each column of sub-units after the first receive the delayed Gate Start Pulse signals and apply the appropriate column data values to their associated column electrodes; and wherein the plurality of sub-units of the large area display are scanned as a single display.

5. A large area display according to claim 4 wherein the means for feeding delayed Gate Start Pulse signals comprises means for generating Gate Start Pulse and Gate Clock signals, the Gate Start Pulse signal indicating the start of a new row of data and the Gate Clock signal indicating that a new column data value is to be supplied, and a programmable logic device which receives the Gate Start Pulse and Gate Clock signals and generates the delayed Gate Start Pulse signals.

6. A large area display according to claim 5 wherein the column data supply means is arranged to supply the column data to the column drivers as a linear series of column data extending across all the columns in all the sub-units of a row of sub-units, and the means for feeding delayed Gate Start Pulse signals are arranged to cause bytes I to N of the linear series of data (where N is a integer equal to the number of columns in the sub-units of the first column) to be placed in shift registers of the column drivers in the first column of sub-units, and bytes (N+1) to 2N to be placed in shift registers of the column drivers in the second column of sub-units.

7. A large area display according to claim 4 wherein at least one of the sub-units is provided, along an edge where it abuts another sub-unit, with optical means arranged to reduce the apparent width of a gap between the sub-units.

8. A large area display according to claim 7 wherein the optical means comprises a lens molded into the viewing surface of the sub-unit.

9. A large area display according to claim 4 wherein at least one of the sub-units is provided with an electro-optic medium which continues over an edge of the sub-unit where it abuts another sub-unit.

10. A large area display according to claim 4 comprising a rotating bichromal member or electrochromic electro-optic medium.

11. A large area display according to claim 4 comprising an electrophoretic medium which itself comprises a plurality of electrically charged particles disposed in a fluid and capable of moving through the fluid under the influence of an electric field.

12. A large area display according to claim 11 wherein the electrically charged particles and the fluid are confined within a plurality of capsules or microcells.

13. A large area display according to claim 11 wherein the electrically charged particles and the fluid are present as a plurality of discrete droplets surrounded by a continuous phase comprising a polymeric material.

14. An electro-optic display according to claim 11 wherein the fluid is gaseous.

* * * * *